US005746569A

United States Patent [19]

Smith et al.

[11] Patent Number: 5,746,569

[45] Date of Patent: May 5, 1998

[54] BAG FORMING MACHINE HAVING ADJUSTABLE SUPPORT STRUCTURE FOR PAIRED WORK ELEMENTS

[75] Inventors: Michael J. Smith; Giles R. Blaser, both of Green Bay, Wis.

[73] Assignee: Amplas, Inc., Green Bay, Wis.

[21] Appl. No.: 600,341

[22] Filed: Feb. 13, 1996

[51] Int. Cl.[6] ..... B31B 01/94; B31B 23/14

[52] U.S. Cl. ..... 414/790.4; 414/27; 493/196; 493/926

[58] Field of Search ..... 198/692; 414/27, 414/790.7, 793, 923; 493/195, 196, 242, 926

[56] References Cited

U.S. PATENT DOCUMENTS

| | | | |
|---|---|---|---|
| 3,287,878 | 11/1966 | Mobley | 493/196 X |
| 4,252,233 | 2/1981 | Joice | 198/692 |
| 4,451,249 | 5/1984 | de Bin | 493/926 X |
| 4,692,134 | 9/1987 | dos Santos Copia | 493/196 |
| 5,056,202 | 10/1991 | Stiegler | 29/33 |
| 5,074,735 | 12/1991 | Stock | 414/27 |
| 5,232,325 | 8/1993 | Kohn | 414/27 |
| 5,419,058 | 5/1995 | Swain | 34/186 |

*Primary Examiner*—Janice L. Krizek

*Attorney, Agent, or Firm*—Andrus, Sceales, Starke & Sawall

[57] ABSTRACT

A bag machine includes a hole forming apparatus with a pair of adjustably mounted hole punches and a wicketing apparatus including a pair of wicket pins. Both the punches and pins are separately adjustably mounted on a slide mechanism for establishing corresponding location in spacing of the punched holes in the receiving wicket pins. Each slide mechanism or assembly includes fixed elongated track having equi-spaced locking elements in the form of spaced recesses in the base of the track. The recesses are equi-spaced. A separate slide element is provided for each of the paired devices for adjustably mounting of the device on the related track. Each slide includes a spring loaded detent plunger aligned with the series of locking recesses. The punch slides are located in alignment with the recesses on the punched track and the plunger released to lock the punches in predetermined hole spacing. The wicket pins are correspondingly adjusted to locate the wicketing pins of each stack unit with corresponding hole-to-hole spacing. In each slide assembly, a single pair of simple detent units control the proper spacing of the punches and the pins.

14 Claims, 6 Drawing Sheets

FIG. 9
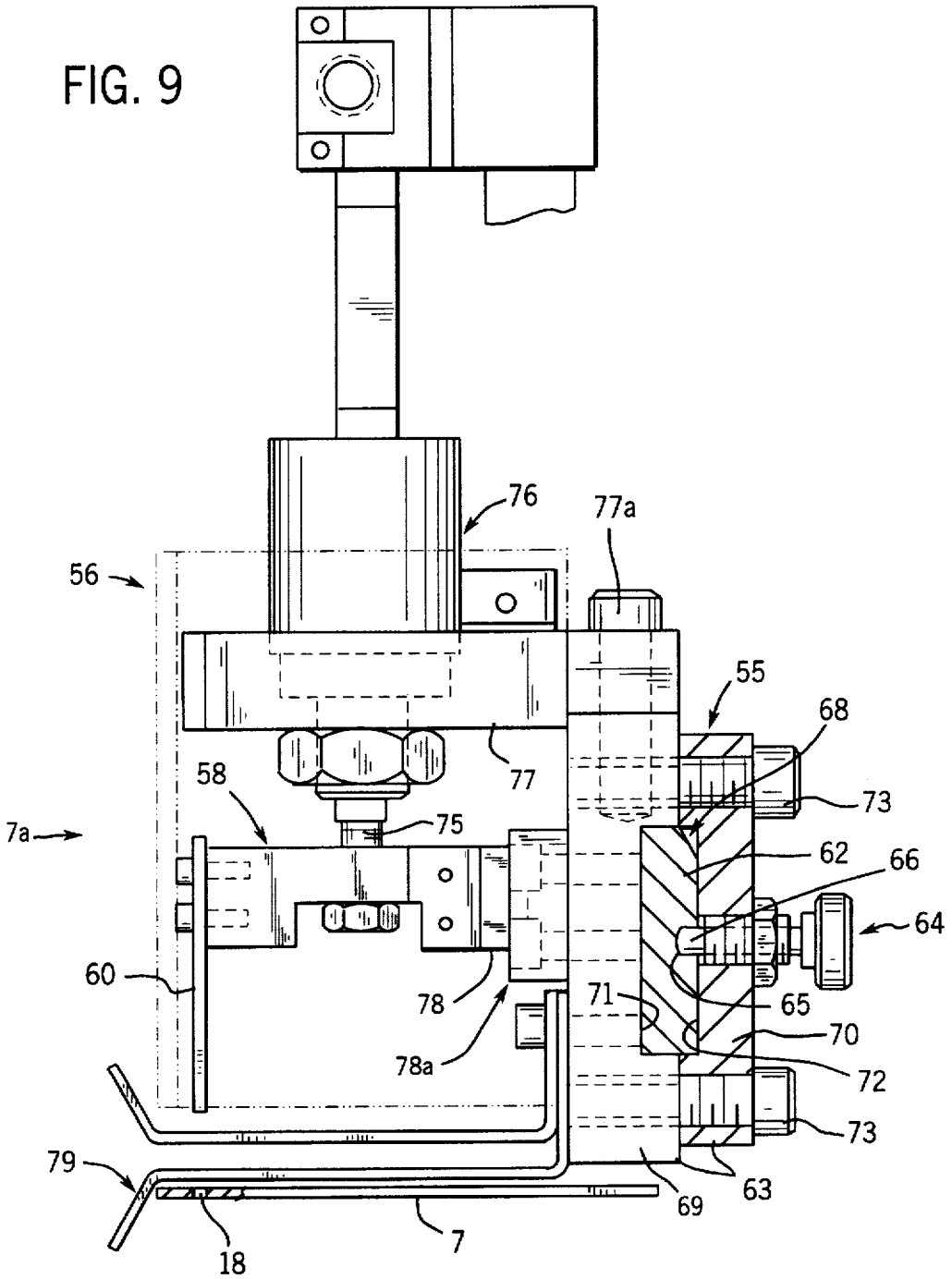
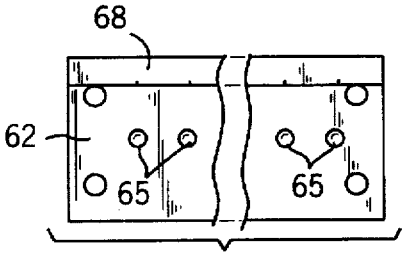
FIG. 10
FIG. 11
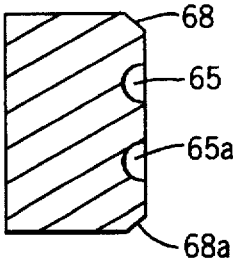

BAG FORMING MACHINE HAVING ADJUSTABLE SUPPORT STRUCTURE FOR PAIRED WORK ELEMENTS

BACKGROUND OF THE INVENTION

This invention relates to a bag forming machine having an adjustable support structure for paired work elements and particularly a bag forming machine having adjustably mounted wicketing pins and hole forming devices for stacking of the formed bags.

In the fabrication and assembly of various flat elements, a stream of the elements are formed and then rapidly stacked into predetermined stacks for subsequent processing. A typical application for fabricating and stacking plastic bags is disclosed in U.S. Pat. No. 5,074,735 to D. Stock which issued Dec. 24, 1991 and is assigned to a common assignee with the present invention. As more fully disclosed therein, a plastic web is formed into a series of interconnected plastic bags with spaced stacking holes. The plastic stream of bags is severed through a suitable cutting system, and then fed to a wicketing apparatus for stacking the bags for subsequent processing. The wicketing apparatus consists of a rotating transfer wheel having a plurality of wicket arms circumferentially spaced about the wheel. The arms project radially from a hub and are structured to receive a single bag from the cutting mechanism with the bag held thereto by a vacuum and rotate upwardly and over the wheel and drop the bag onto a stacking machine. In addition to being cut, the bags are often formed with a pair of laterally spaced stacking holes on one edge of the bag. The stacking machine includes an endless drive conveyor with immediately adjacent stacking platforms. The stacking machine is operated in a stepped manner to sequentially align the stacking platforms to receive a series of the bags. Each platform has a pair of longitudinally spaced pins, with the spacing corresponding to the spacing of the stacking holes in each bag. The continuous rotation of the transfer wheel deposits a predetermined or selected number of bags to an aligned platform. Upon receipt thereof, the stacking machine rapidly indexes the drive and filled platform to align a new platform with the transfer wheel with the wheel arms, and then stops to allow stacking on the newly aligned platform and removal of the previous stacks. At the discharge end of the stacking machine generally an automatic transfer of the stacks will be effected through an appropriate mechanism or other transfer apparatus.

The stacking holes in the bags or other elements may not have a constant spacing, but rather for any given line of bags may require some variation in the spacing. Thus, it becomes critical that the stacking mechanism include a pin supporting structure to allow spacing of the pins to correspond with the spacing of the holes.

Generally the spacing of the pins is in well known increments and various mechanisms have been provided for adjusting the spacing in accordance with the standard hole spacing. Thus, the above identified Stock patent discloses a supporting structure on each platform with a plurality of longitudinally spaced pin supporting openings, each having a pin locking mechanism. This permits relocation of the pins into the several openings in accordance with a predetermined spacing increments. The pins are locked in rigid orientation within the platform by spring loaded locking detent members provided in alignment with each pin hole. Although this system provides a satisfactory and highly practical support, the system with the multiple locking detent members contributes to the initial cost as well as maintenance of the equipment. Other pin locating systems are disclosed in the prior art encountered in the lot as noted in such patent. Thus, for example, U.S. Pat. No. 4,252,233 issued Feb. 24, 1981 discloses a system providing for an essentially continuously variable repositioning of a wicket pin. This system is considered to present additional problems. The system requires the accurate setting by the personnel and is subject to error as a result of inadvertent intention of the adjusting personnel or the complete lack of ability of the personnel to effect the careful placement and adjustment. In addition, the system of the latter patent requires sequential release of various clamping bolts and the like, followed by the retightening of such clamping mechanisms after the adjustment. This again requires the appropriate attention of the adjusting personnel, and in any event, is relatively time consuming and therefore costly.

The machine or apparatus for forming the stacking holes similarly includes paired punch units which are adjustably mounted to provide the proper spacing in accordance with the bag specification. The punch units and support structure present similar problems and consideration as the wicket pin regarding the supporting structures.

A need exists in the art to maintain simplicity and accuracy of adjustment of work members including the wicket pins and the hole punches, such as the pin adjustment disclosed in the above Stock patent, while minimizing initial cost and maintenance probabilities and permitting cost effective maintenance when the pin, punch or other similar adjustment structure requires attention.

SUMMARY OF THE PRESENT INVENTION

The present invention is particularly directed to a support structure for positioning of work members relative to each other in bag forming machine line wherein individual supports maintain the simplicity of the spring loaded detent mechanism of the Stock patent, while minimizing the components parts and costs, maintaining rapid work spacing adjustment and a highly cost effective work adjustment fabrication system for initial fabrication. The invention is particularly useful in wicket pin setup and the related hole punch setup in a bag forming line, and is described as applied thereto.

Generally, in accordance with the teaching of the present invention for a wicket structure machine, each platform or other structure for receiving a stack of elements includes an attachment unit for mounting of the apparatus to receive the bags. A slide assembly is provided on the attachment unit consisting of a slide track secured to the attachment unit and a separate slide member mounted to said track for each of the pins. Each slide member includes a pin support, and preferably a releasable pin support. The pin is firmly fixed to or mounted to the slide member for positioning along the track. The track includes a series of longitudinally spaced locking elements. A manually positioned movable locking element is mounted on the slide in alignment with the locking elements on the track. The movable element is manually positioned to engage a spaced locking element, and thereby releasably lock the slides and attached wicket pin in selected spaced relation. The slide is selectively aligned with the locking element to set the spacing of the two pin locations and thereby the two pins in accordance with the hole-to-hole spacing of the holes in the bag or other flexible element. The locking units fixedly secure the slides and thereby the pins in proper spaced relation for receiving the bags or other flexible element. The assembly requires a single manually operated locking mechanism for each pin support. The locking system preferably is a detent locking mechanism having a spring-loaded plunger in each slide for engaging one of a series of locking openings, recesses or the like on a track. The detent mechanism provides a particularly strong and cost effective mechanism for locking of the slide assembly in appropriate position for accurate location of the pins. The spacing of the pins is only limited by the spacing of the detent locking members and the number thereof.

The detent mechanism is preferably described as a spring loaded member. Any other type of a locking detent or other mechanism with a manually movable locking element can be used which provides a reliable, stable, direct, and substantially manually operable locking structure so as to reliably maintain and support the wicket pin slide.

The detent mechanism can be readily applied with a vertically moving or horizontally moving detent member. The slide member is formed with the interlocking mechanical construction overlapping and with the interlocking vertical horizontal portion of the track, respectively. In a preferred construction, the interlocking portion is provided with a plurality of specially spaced locking recesses or openings or the like, and a spring loaded detent locking member is appropriately mounted in the slide aligned with the corresponding portion of the track.

In a practical installation, a plurality of units including the pin support system is attached to a conveyor for sequential alignment with a wicket transfer wheel for automated stepped positions of the units in alignment with the wheel. The conveyor is normally adjustably mounted to align the adjusted pins with the transfer of the bags onto the pins. The wicketing apparatus is mounted in line in a bag forming line including a punch unit for forming the holes in each bag.

As applied to the hole forming apparatus or machine, a pair of punch units are actuated during the dwell period of the web flow to form the spaced holes in the appropriate portion of the bag. The punch unit has the same requirements as the wicket pins, and in particular, must be adjusted and set to the selected hole spacement for the particular bag being formed. In accordance with the present teaching, the punch units are secured to an adjustable slide assembly. In one embodiment, the slide assembly includes an elongated track bar mounted in fixed relation to the machine and extending parallel to the web path. Each punch unit is secured to a slide including a pair of side plates secured about the track bar. The track bar has a row of longitudinally spaced locking elements such as detent recesses on one wall. The slide plate abutting the one wall has a spring-loaded plunger aligned with the row of locking recesses for selective locked placement of the punch units on the track bar and thereby the web.

A wicketing apparatus or punch apparatus including the adjustable support constructed in accordance with the teaching of the present invention and are readily fabricated with commercial technology and components, which is both cost effective in the initial fabrication and subsequently required maintenance. The requirement of only two locking units per platform requires a minimum cost and maintenance. The slide structure and detent locking systems are known rugged and reliable assembly devices.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

Figure 8:
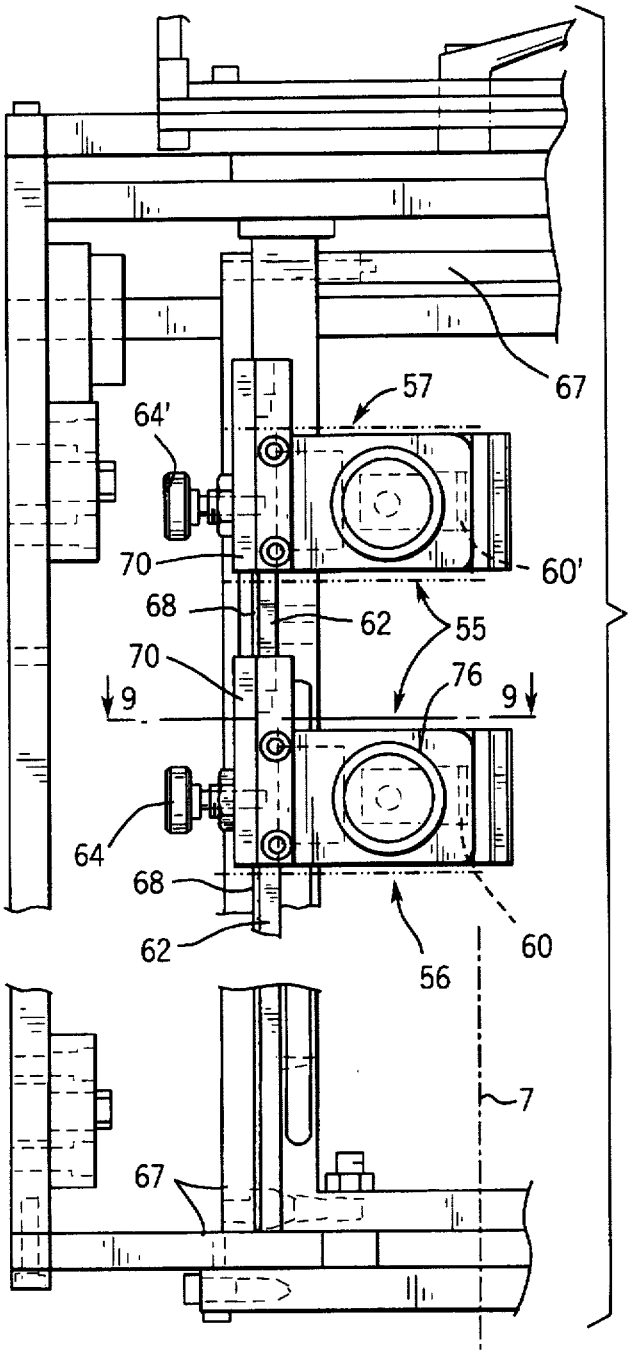

FIG. **7*a*** is an embodiment of the track structure of the prior art embodiment constructed for pin location adjustment;

FIG. **7*b* is a further pin location adjustment based on the embodiment of FIGS. 1–7**;

FIG. 8 is a top view of a hole forming machine;

FIG. 9 is an enlarged view, taken generally on line 9—9 of FIG. 8, of a punch unit shown in FIG. 8;

FIG. 10 is a separate fragmentary elevational view of a track bar shown in FIGS. 8 and 9; and FIG. 11 illustrates an alternate scale bar unit adapted for use with the punch unit structure shown in FIGS. 8–10.

DESCRIPTION OF THE ILLUSTRATED EMBODIMENT

Figure 1:
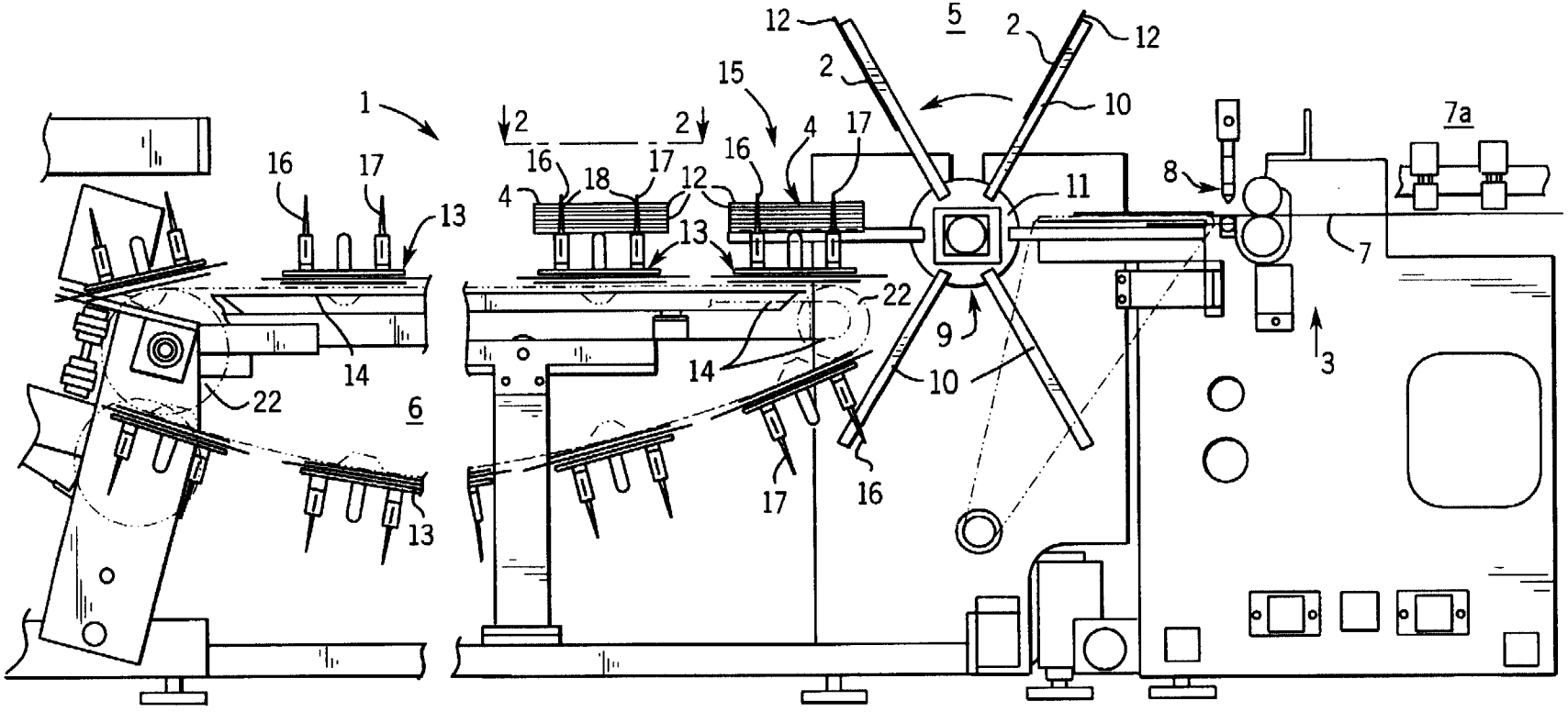
FIG. 1 is a simplified illustration of a bag wicketing and stacking assembly line.

Referring to the drawings, and particularly to FIG. 1, a stacking unit 1 is illustrated for receiving a stream of flexible elements, such as plastic bags 2 from a bag forming machine 3, operating in stepped sequence including a dwell period for forming a transfer period for moving the bags down the line. The stacking unit 1 forms successive stacks 4 of the plastic bags 2. A transfer unit 5 transfers the bags from the stream of incoming bags 2 onto an indexing conveyor 6. The bag forming machine 3 and transfer unit 5 as well as the indexing conveyor 6 may be of any suitable or known construction. Generally as illustrated, the bag forming machine 3 will receive an incoming folded web 7. A hole punch unit **7*a* is located upstream to form spaced stacking holes in the edge portion of the web in each portion of the web 7 forming one bag. A sealing knife unit 8, shown down stream of unit 7*a*, will selectively seal and sever the incoming web and form a stream of individual bags 2, which are then passed into transfer unit 5**.

The transfer unit 5 is a well known structure and is thus diagrammatically illustrated. A rotating wheel 9 has an axis of rotation fixed and normal to the path of the bag stream. A plurality of laterally aligned pairs of arm 10 are circumferentially secured to a rotating hub 11. The arms 10 project radially outwardly to define a supporting surface of a sufficient width to receive and support a bag 2, with the outermost sides or ends of the bags 2 generally projecting outwardly of the arms as at 12. The arms 10 each have surface openings, not shown, coupled to a vacuum source, not shown, to hold a bag to the arm.

Rotation of the wheel 9 is correlated with the cycle time of the bag forming machine 3 to align an arm 10 with each incoming bag 2. The vacuum in each arm holds the bag in place and bags 2 are thereby transferred from the incoming stream onto the conveyor 6 forming a part of the stacking machine or unit 1. The bags 2 are secured to the arms 10 through the vacuum system and as the arms rotate, the bag 2 is located beneath the surface of the arm and in overlying relationship to the conveyor 6. Releasing of the vacuum releases the bag 2 which is then transferred onto an aligned stacking unit 13 of the indexing conveyor 6.

The illustrated conveyor 6 is of a basically known construction and includes an endless conveyor unit with a pair of spaced and endless chains 14. A plurality of stacking units 13 are similarly constructed and secured in longitudinally spaced relation to the chains 14 for successive alignment with the arms 10 at the stacking station 15.

The conveyor unit 6 includes a step drive, not shown, to move the units 13 into successive alignment with the arms 10 of the transfer unit 5. In accordance with known practice, each unit 13 includes a pair of wicket posts or pins 16 and 17. The bags 2 are formed with stacking holes 18 on a longitudinal projecting edge portions 12 of the stream of bags, formed by punch unit 7*a* in the bag forming line upstream of the transfer unit 5. Pins 16 and 17 are spaced longitudinally in accordance with the spaced stacking holes 18 provided in the aligned edge portion of bag 2. Thus, as the transfer unit 5 rotates, it deposits a series of bags 2 onto the aligned wicket pins 16 and 17 of a unit 13. After a predetermined number of bags have been placed onto a given unit 13, the aligned stacking unit 13 is indexed from the alignment and simultaneously a new unit 13 is moved into alignment.

One embodiment of the present invention is particularly directed to the construction of each of the units 13 and particularly the support of the wicket pins 16 and 17 in such a manner as to permit variations in the longitudinally spacing thereof. Bags 2, in any given stream, are formed with a known hole-to-hole spacing. Different lines of bags, however, may have different hole spacing requirements and consequently the wicket pins 16 and 17 must be correspondingly reset to conform to the prepunched spaced holes or openings 18. The support of the pins 16 and 17 is now described in detail. The other components may, of course, take any known or desired construction and no further description thereof is given.

Figure 2:
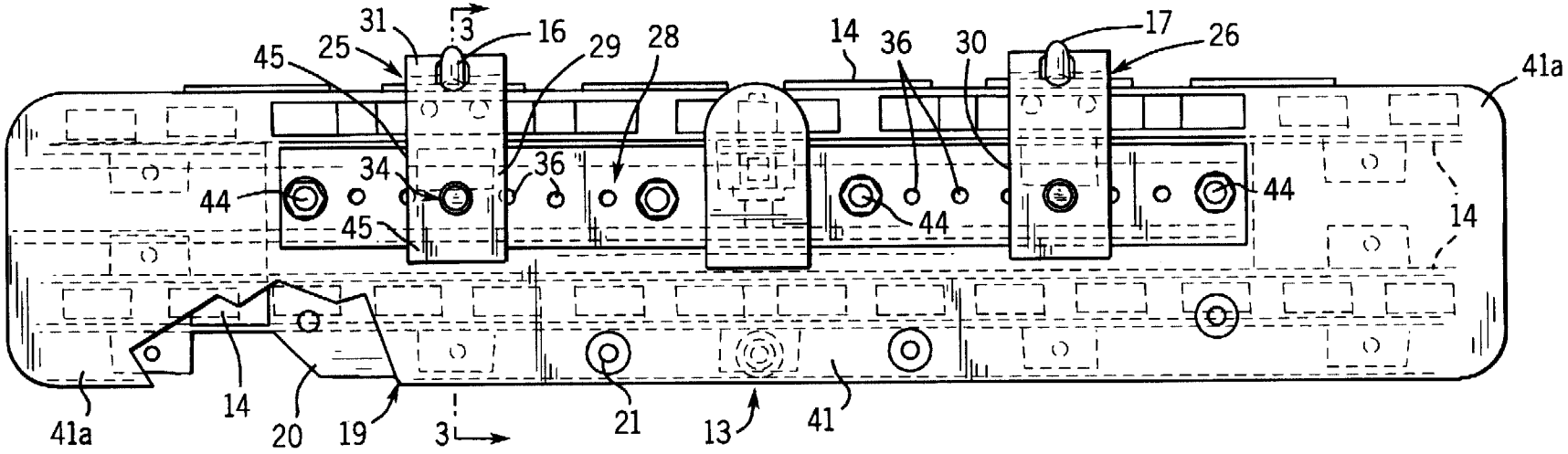
FIG. 2 is an enlarged plan view of a single platform unit of the stacking machine taken generally on line 2—2 of FIG. 1.
Figure 3:
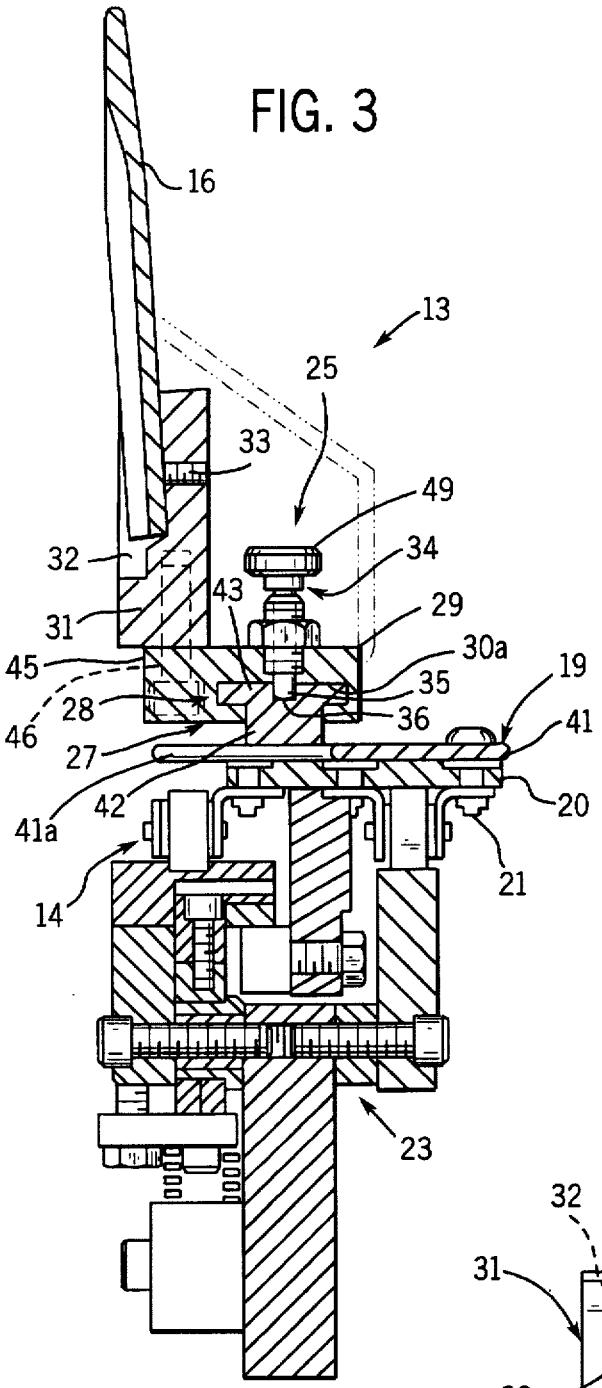
FIG. 3 is an enlarged vertical section taken generally on line 3—3 of FIG. 2.
Figure 4:
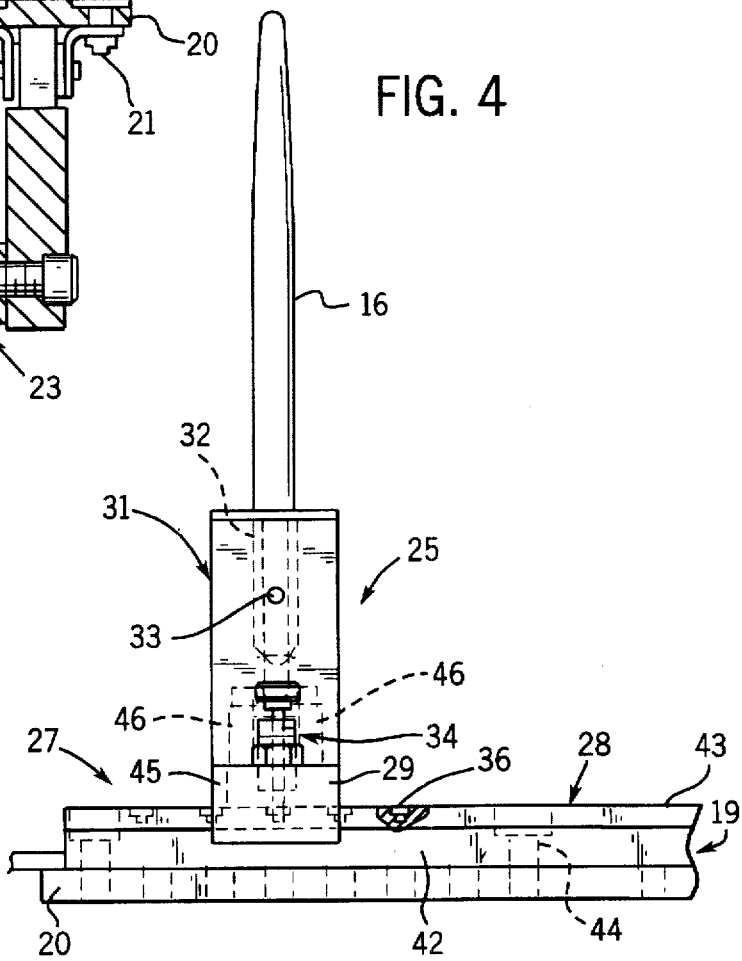
FIG. 4 is a fragmentary front elevational view of the pin support structure shown in FIGS. 1–3.

Referring particularly to FIGS. 2–4, each unit 13 includes a platform unit 19 fixed to the drive chain 14.

The platform unit 19 consists of a rigid base plate 20 which is firmly fixed to the drive chain 14 in any suitable manner as by spaced boles, pop rivets, or other suitable locking members 21. The chains 14 are coupled to end sprockets 22 (FIG. 1) for moving platform 19 into the loading station 15. A supporting structure 23 (FIG. 3) within the upper linear run of the conveyor 6 supports the platform units 19 and chain drive system in position for receiving and transporting of an appropriate stack of bags 2. The stacked bags 2 are moved in steps to the discharge end of the conveyor 6. Each platform unit 19 includes a pair of wicket pin support units 25 and 26 (FIG. 2) for pins 16 and 17 respectively. The supports 25 and 26 are slidably mounted on a slide unit 27 secured to the base plate 20, and provide for proper spacing of pins 16 and 17. Slide unit 27 includes a T-shaped track 28 secured to the base plate and common to both units 25 and 26. Separate T-slotted slides 29 and 30 are provided for units 25 and 26 and therefor pins 16 and 17, respectively.

Figure 5:
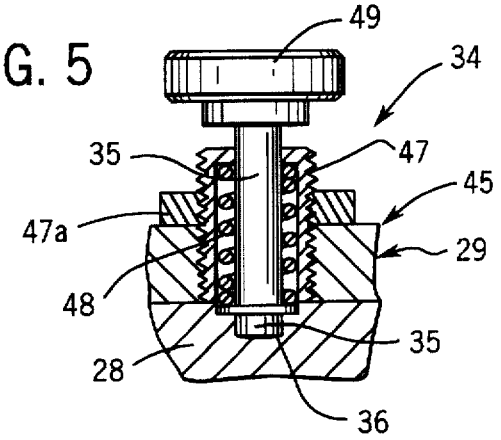
FIG. 5 is an enlarged sectional view of a spring loaded detent unit shown in FIGS. 1–4.

Referring particularly to FIGS. 3 and 4, the detail units 25 and 26 is described with respect to unit 25. Slide 29 is constructed with a T-shaped bottom slot or opening 30*a* (FIG. 3), and is slidably supported on the T-shaped track 28. Referring to slide 29, a pin holder 31 is located to the outer portion of the slide and is constructed with an appropriately angled opening 32 to releasably support wicket pin 16. The pin 16 is firmly secured in place in the illustrated embodiment of the invention by a clamp member 33, shown as a small set screw to firmly and fixedly releasably attach the pin 16 to the pin holder 31 on slide 29. A detent plunger assembly 34 forming a locking unit is secured to the top of the slide 29 inwardly of the wicket pin holder 31. Referring to FIGS. 3 and 5, the assembly 34 includes a spring-loaded plunger 35 which extends downwardly through slide 29 for engagement with one of a series of locking elements, shown as openings or recesses 36 (hereinafter generally referenced as openings 36) provided in the top of the T-shaped track 28.

The pair of pin support units 25 and 26 are longitudinally spaced on the opposite halves of the platform unit 19, with the track 28 extended throughout the platform. The track includes a similar plurality of openings 36 which are similarly spaced from each other. The detent assembly thus provides for locating of the wicket pins in longitudinally spaced relation to each other in accordance with the location of the openings 36 for proper location of the wicket pins 16 and 17 in accordance with the stacking holes 18 in bags 2.

The hole spacing conforms to well known hole spacings in the art of forming bags, particularly plastic bags formed of a thin plastic film. Thus, wicket pins 16 and 17 project upwardly to the opposite sides of the wicket transfer unit. The bags 2 are deposited on the wicket pins 16–17 with the plastic bag dropping downwardly to the outer side of the conveyor 6.

The illustrated detent support, using a single detent unit for each wicket pin, provides a simple, reliable, and low cost system for adjusting of the wicket pin assemblies. The adjustment is rapid, accurate and accomplished with minimum time and skill as well as without significant danger of error.

Referring to the drawings, and particularly to FIGS. 2–4, the rigid platform plate 20 is secured to the chain drive and supported through the suitable interconnecting support structure 23. Support structures are well known and no further description thereof is given herein.

A generally U-shaped stack plate 41 is secured to the top of the base plate 20 with end portions 41*a* of the plate 41 located outwardly of the track 28. The T-shaped track 28 of the slide units is shown as a solid plastic member, such as a MC901nylon, but may be formed of any suitable material. The illustrated track, as most carefully shown in FIGS. 3 and 4, has a relatively heavy stem 42 and a relatively small cross bar 43 extending laterally across the longitudinal direction of movement. The track 28 is an elongated member extending throughout the length of the platform assembly between the ends 41*a* of the stack plate and particularly within the cutout portion of the U-shaped stack plate 41. The track 28 is shown secured to the rigid base plate 20 by four spaced bolts 44 (FIGS. 2 and 4), which pass downwardly through the T-shaped track and thread into the base plate 20. It thus provides a rigid base for the slide structure.

The slide 29 includes a body 45 which is a short block of metal or other suitable material and has a limited width. Generally as shown in FIG. 2, the block body 45 extends over approximately the spacing enclosing three of the locking openings 36. The underside of body 45 is formed with the T-shaped slot 30*a* which mates with the T-shaped track 28. Block body 45 extends laterally from the T-bar track 28, as shown in FIG. 3, to locate an outer portion to one side of the drive chain 14 and platform unit 19. The pin holder 31 is also shown as a separate metal block which is bolted to the outer end of the slide body 45 and projects upwardly therefrom. The holder 31 is secured to the slide body 45 by a pair of bolts 46 and has the pin receiving opening 32 for mounting a pin generally of the construction illustrated in the previously identified Stock patent. The pin support 31 and body 45 may be formed as a one-piece unit.

The locking detent unit or assembly 34 includes the spring loaded plunger 35 constructed as a readily assembled component. Referring particularly to FIG. 5, a threaded tubular body 47 is threaded into a vertical threaded opening in the slide body 45 which is precisely aligned with the row or line of openings 36 in the track 28. A lock nut 47*a* is threaded onto and tightened down into abutting engagement with the top face of the slide body 45 to lock the tubular body 47 in location. The plunger 35 is journalled in the tubular body 47. A coiled spring 48 within the body continuously urges the plunger 35 downwardly into engagement with the face of the T-shaped track 28. A handle 49, shown as a simple knob, is secured to the upper end of the plunger 35 for raising of the plunger 35 and removing the outer end from locking engagement with an aligned opening 36 for positioning the slide body 45 and therefor the pin 16 on the track 28.

The location of the stacking conveyor 6 with respect to the wicket wheel 5 must locate the wicket pins 16, not only properly spaced but in alignment with the holes in each bag moving from the wicket wheel 5 to the wicket pins. Although the pins 16 are tapered with a relative sharp receiving end to accommodate slight variation in the positioning of the bag, rather precise alignment is particularly desired, if not necessary, as the speed of the bag forming line increases. With the prior art devices, the conveyor 6, as a standard construction, is mounted on a movable track support to permit adjustment of the conveyor and thereby particularly each stacking unit 13 relative to the wicket wheel 9 to maintain the desired preset alignment of the wheel 5 and the receiving stacking units 13. The adjustment is of course somewhat related to the accuracy of the position of the pins by the set up personnel. With the present invention having substantially precise location of the pins in accordance with the forming of the holes, the degree of adjustment required in the placement of the conveyor unit is minimized and permits more reliable preset of the system by the set up personnel.

Thus, with the present invention, the pins 16 and 17 are fixedly secured to the respective slide units 25 and 26 and firmly and positively supported as an integrated part of each stacking unit 13 for continuous movement into and from the wicketing station. The pins 16 and 17 are appropriately spaced by simply grasping knob 49, releasing of the detent plunger 35 and positioning of the slide in alignment with an appropriate opening 36. The alignment is readily and quickly provided with the openings 36 providing for proper spacing between the pins 16 and 17 upon release of the plunger 35.

The step adjustment in spacing of the wicket pins 16 and 17 is done without the necessity of any tools and without any special skill or knowledge. This not only permits simple, reliable adjustment, but eliminates the downtime often associated with tool-based adjustment mechanisms. The use of special trained personnel is generally completely eliminated, increasing the production time of the machine.

Alternate structures will be readily provided by those skilled in the art, using the basic slide structure with a manually operated lock arm or member for each slide member, with predetermined spacing provided for rapid and efficient positioning of the slide structure.

Figure 6:
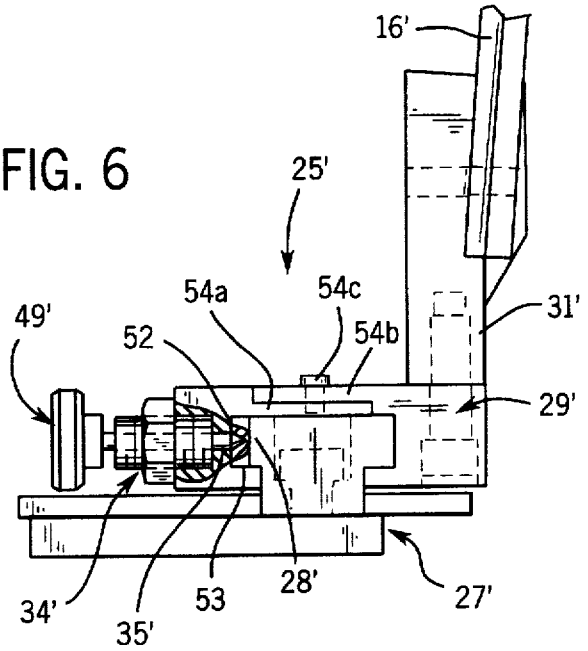
FIG. 6 is a fragmentary side elevational view of a pin support assembly illustrating an alternative construction of the pin locking mechanism.
Figure 7:
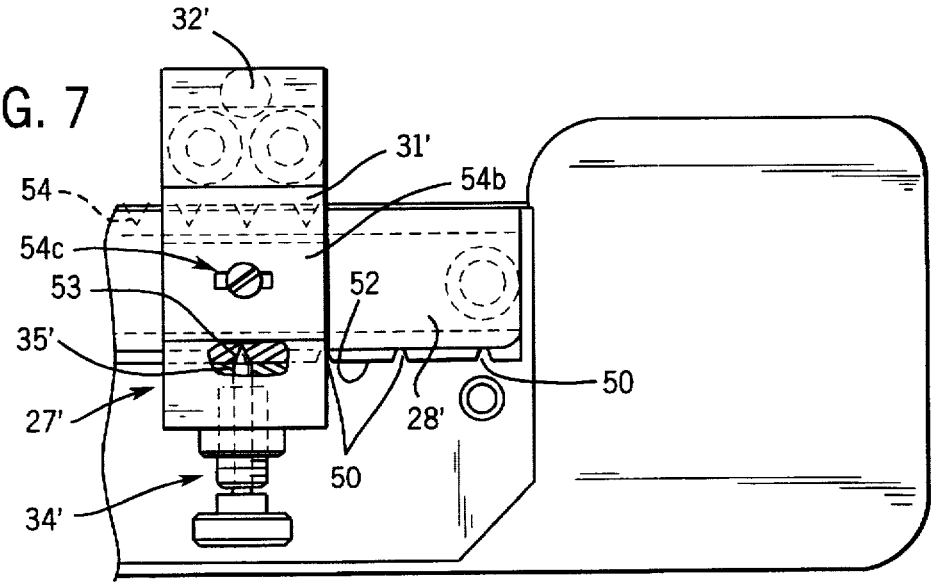
FIG. 7 is a plan view of FIG. 6.

One alternative structure is disclosed in FIGS. 6 and 7. In this embodiment, the structure is essentially identical to that of the first embodiment and corresponding elements are defined by corresponding primed numbers. The difference resides in the horizontal orientation of the detent locking mechanism.

In the second embodiment, the outer, vertical face of the track 28' is provided with a series of recesses, each in the shape of a V-groove 50. The V-grooves 50 are equi-spaced by a preset distance to permit the incremental adjustment of the pin setting. Any arrangement of the V-grooves or other locking openings may be provided. A detent plunger unit 34' is secured to the slide 29 in alignment with the inner face 52 of track 28' and with plunger 35' having a pointed end 53 to mate with any V-groove 50.

The detent plunger unit 34' is thus secured to locate plunger 35 horizontally movable but otherwise essentially identically mounted to that illustrated in the first embodiment. For adjustment of a pin 16', or 17', the operator merely releases the locking detent plunger 35' from the then engaged V-groove 50 in the track, and moves the slide 29' to an appropriate spaced V-groove 50 in accordance with the desired spacing. Releasing of the plunger 35 again locks the pin support 25' directly into an appropriate location. The operator will readily know that when the slide is properly placed by a mere pressurized attempt to move the slide once the plunger is released.

The V-grooves 50 may be spaced in accordance with the decimal system or the metric system of measurement. Further, track 28' may be formed with V-grooves in one system and the opposite edge formed with V-grooves 54' in the other system. The track 28' is formed with the opposite grooved edges symmetric to the attachment elements to permit rather desired mounting of the track.

The present invention can however provide for further minute adjustment of the pins relative to each other. In the structure shown in FIGS. 6 and 7, the movable slide member is formed of two overlapping parts 54*a* and 54*b* which are coupled to each other through a releasable connection such as a slot and screw unit 55*c* to permit slight relative movement of the two parts of the slide member, longitudinally of the slide unit and particularly track 28'. The locking unit 34' is mounted to the one part 54*a* and the pin holder 31 is mounted to the other movable part 54*a*, thereby providing for minute adjustment of the pin spacing relationship.

The predetermined spacing of the locking elements provides for rapid and optimum positioning of the punches and pins in the normal bag-line operation. However, in the normal operation, particularly with the increasing high speeds, the bag machine may develop a small but acceptable variation in the form of the bag. Thus, wrinkles in the bag may tend to slightly shift the hole placement such that when the bags are carried by the wicketing apparatus to the wicketing conveyor, misalignment may occur resulting in faulty stacking. The variation in the hole spacing will not occur often but when it does occur, a slight minute slide adjustable feature permits stopping of the machine and adjusting the pin slide or slides to compensate for such acceptable bag formation. The amount of the adjustment would normally be minute and can be readily attended to by the machine operator.

Figure 7A:
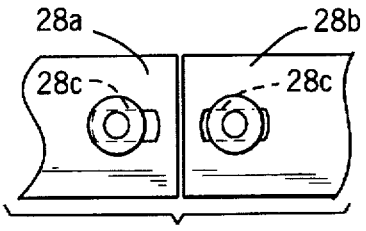

The slight adjustment system may further be provided by providing a split track structure such as shown in FIG. 7*a*. The track structure has the track formed of similar half sections 28a and 28b, with at least one of the sections firmly bolted in place through a slotted connector 28c. The system of FIG. 7a should be less costly and also stronger, while permitting the slight adjustment as required for some slight hole location variation due to the feed system or otherwise.

Figure 7B:
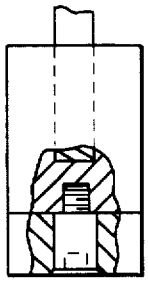

Further, where the pinholder 31 is separately attached to the slide body 45, a slotted connection therebetween may also provide for the slight adjustment. For example, referring to FIG. 7b, a slot and screw connection of the holder 31 to body 45 is illustrated. Such system would also be readily provided as a cost effective structure having the necessary strength.

The present invention may of course be used for stacking of any flexible element having the spaced holes. The embodiments illustrated have been particularly used for stacking plastic bags.

As previously noted, the teaching of the present invention may also be readily applied to the hole forming machine 7a for forming of the stacking holes in the bags as the web moves through the forming line. Referring particularly to FIGS. 8–10, an illustration of a hole forming machine 7a incorporating a punch slide assembly 55 supporting a pair of punch units 56 and 57 and forming an embodiment of the present invention. The punch units 56 and 57 are thereby movably supported for spacing longitudinally relative to each other in accordance with the bag hole specification. Each illustrated punch units 56 and 57 are structurally the same and unit 56 is described in connection with FIGS. 8 and 9, with corresponding elements of unit 57 identified by corresponding primed numbers.

Referring particularly to FIGS. 8–10, the punch unit 56 includes a vertically reciprocating ram 58 coupled to a knife 60. The ram 58 is secured to the slide assembly 55 for longitudinal movement and positioning the punch unit 56 along the path of the web 7. The knife 60 is thereby placed in selected alignment with the web 7 to form the stack opening or holes in an appropriate location on the edge portion of the web for the bag formed therefrom.

The slide assembly 55 which forms an embodiment of the invention, includes an elongated rigid bar defining a track bar 62, more clearly shown in FIGS. 9 and 10. A two-piece slide 63 is clamped about the bar 62 and is movable along the length of the bar 62. A detent unit 64 is mounted to the exterior side of the two-piece slide 63. The bar 62 includes a line of locking elements, shown as detent recesses and openings 65 in the face of the slide bar 62. To reposition the ram 58 and interconnected knife 60, the detent unit 64 is released, and the total assembly moved along the bar 62 to align the detent unit 64 and particularly a plunger 66 with an appropriate locking opening 65 and release the detent unit 64 to lock knife 60 in alignment with the proper web portion for forming of a stack opening or hole. The assembly allows the relatively precise stepped alignment of the knives 60 and 60' relative to each other for forming of the spaced stacking holes.

More particularly, in the illustrated embodiment of the invention of FIGS. 8–10, the slide bar 62 is an elongated bar extending longitudinally of the web path. The slide bar 62 is a rectangular bar set on an edge and secured at the opposite ends to the frame structure 67 of the hole forming machine 7a. One end of slide bar 62, shown as the upper and outer edge, is provided with a reference scale 68, which is readily viewable by the control personnel. The outer face of the slide bar 62 is provided with the equally spaced recesses or locking openings 65. Referring particularly to FIG. 8, the two piece slide 63 includes a plate 69 and an outer clamp plate 70. Plate 69 is a thick and heavy construction and includes a recess 71 in the outer face receiving the track bar 62. The depth of the recess 71 is slightly over half the thickness of the track bar 62. The outer clamp plate 70 has a recess 72 corresponding to the projection of the bar 62 from the plate 69 and is located in overlying relationship to the track bar 62 and abutting the plate 69. The plates 69 and 70 are joined as by bolts 73 to slidably support the same on the bar 62.

The detent unit 64 is illustrated as a spring loaded plunger 66 corresponding to the detent unit previously shown in connection with the pin support and structure.

The slide bar 62 may also be made with separate scales for the decimal system and the metric system, for example, as shown in FIG. 11. The slide bar 62 has the scale 68 on the one edge with a decimal scale for example. The opposite lower edge has a metric scale 68a. In this embodiment, separate and related rows of locking openings 65 and 65a are offset vertically and are spaced in relation to the respectively adjacent scales 68 and 68a. In this embodiment, the detent unit 64 would be offset from the center to align with either one of the rows 65 and 65a which is located as the upper most row. Thus, bar 62 is readily clamped in place with either row as the upper row and with the locking openings facing outwardly.

The ram 58 is mounted to the end of piston rod 75 of a valve-operated air cylinder assembly 76. The assembly 76 is secured to mounting block 77 which is bolted or otherwise secured to the plate 69 of the slide 63, as by bolts 77a. The ram 58 and air assembly 76 are moved as a unit. The inner end of the ram is formed with a generally U-shaped coupling member 78 mating with a guide block 78a secured to the inner face of the slide plate 69. A stripper member 79 is located beneath the knife and above the web and insures removal of the web from the blade 60 as the blade is retracted.

In the illustrated embodiment of the invention, the allowable placement of the punch units 56 and 57 are thus predetermined by the spaced locking elements on the track bar 62. The operating personnel merely releases the plungers 66 and 66' of the respective detent units 64 and 64' for the punch units 56 and 57 to position the knives 60 and 60' in predetermined location with respect to the web 7. During the dwell period of the line and web movement, that is, during the severing of the web to form the bags by operation of the severing unit, the knives 60 and 60' are actuated to form the holes in the bags. The punch slide assembly 55 with the multiple preset openings for presetting of the bags in combination with the simple manually operated release mechanism provide a highly improved and significant manner of positioning the punch units.

The illustrated embodiments of the invention provide simple, reliable and effective wicketing pin setting apparatus and hole punch apparatus. Although shown with spring-loaded detent mechanism, other forms of detent mechanism with a direct manually actuated locking arm or the like may readily be employed. The most significant aspect is to maintain a simple, manually operated unit, having an actuator on a slide member for selective engagement with preset spaced locking elements on a track mechanism so as to maintain simplicity and ease of operation while maintaining very accurate location of the pins.

The illustrated embodiments of the invention are shown and described in detail to provide what the inventor presently considers the best embodiments. Various modifications and other embodiments will be readily provided by those familiar with the art based on the teaching of the present invention and future as well as present technology. Thus, various other slide structures can readily be provided. For example, the slide structure may be inverted with a U-shaped member mounted as a track and a generally meshing T-shaped or even L-shaped member coupled to the U-shaped track to form the slide. In the detent unit, the interlocking ends of the slide mounted member and the locking openings of the track may be reversed. Side interlocking slide structures may also readily be provided. Basically, a track member is provided for each set of working elements to be located relative to each other. Individual slide units are movable longitudinally of each other on the track member with appropriate spacement in combination with simple manually hand-actuated release and lock units, consisting of a spaced lock member on the track in combination with a simple and substantially hand operable locking member on each of the individual pin slide units. Thus, the personnel need only move the pin slide unit to a locking member on the track and reposition the interlocking mechanism. Although the locking mechanism is preferably and uniquely a simple hand-operated release and set mechanism requiring a very simple direct motion, a lever actuation may be employed for use if a relatively strong locking mechanism is provided. For example, in the illustrated embodiments, the spring loaded decent mechanism might be provided with a heavy spring loading which would require application of a simple lever member to overcome the spring locking. A high pressure but manually rotatable cam locking mechanism might be used; again with a suitable simple manually operated lever. Other variations of the illustrated structure will of course be readily provided such as an integrated slide or single piece, pin holder and pin structure. A separate pin holder and pin structure may be desirable for releasable connection to the slide if different pin structures are desired.

The other features of the conveyor, platform and wicket apparatus or even other infeed mechanisms may of course also be provided to sequentially supply and align the individual apertured bags to the stacking units.

Various modes of carrying out the invention are contemplated as being within the scope of the following claims particularly pointing out and distinctly claiming the subject matter which is regarded as the invention.

We claim:

1. In a bag forming machine having a web passed through a bag forming line, said line having at least one work station having at least two aligned first and second working members for working of each bag, an adjustable support structure for presetting the spacing between said working members, said adjustable support structure comprising a slide assembly having a common support track member extending longitudinally of the web, said track member having a plurality of spaced locking elements longitudinally spaced along the track member, a first slide member and a second slide member mounted on said track member and each independently movable along the length of the track member for alignment with said spaced locking elements, said first and second slide members adapted to be connected to said first and second working members respectively, each slide member having a single manually operated locking element aligned with said spaced locking elements on said track member, said manually operated locking element being manually operable for selective manual release and engagement with an aligned locking element of said track member for quick and accurate readjusting and placement of the slide members in alignment with a predetermined one of said spaced locking elements for orienting of said working members in a corresponding spacing from each other.

2. The apparatus of claim 1 wherein said track member is an elongated rigid track bar having a first side and a second side, a first slide member and a second slide member correspondingly constructed, each slide member comprises a first plate having a recess mating with the first side of said track bar and having a second plate having a recess mating with the second side of said track bar, said plates including attachment elements for securing of said plates to each other for sliding movement of the slide members on said track bar, said locking elements of said track member being located on said second side of said track bar and said manually operable locking elements being releasably secured to said second plate.

3. The apparatus of claim 1 wherein said track member includes a generally T-shaped configuration, said first and second slide members each including a recessed body mating with said T-shaped track member and slidably supporting the slide members on said track member, and interconnecting said slide members to said track member for sliding thereon.

4. The apparatus of claim 1 wherein each of said first and second slide members are similarly constructed of a first part and a second part, said first part being connected to and supporting the working member, said second part including said manually operated locking element, said first and second parts including a releasable interconnection permitting limited adjustment of the first part relative to the second part on said track and thereby providing for minute limited adjustment of the work member relative to said manually operated locking element and thereby providing for slight adjustment of the relative spacing of the work members in relationship to the positioning of the manually operated locking element to the spaced locking elements on the track member.

5. A wicketing apparatus for sequentially aligning individual flexible element stacking structures with a transfer unit for stacking thin flexible elements having spaced holes along a given portion of each flexible element, the flexible element being designed with different hole-to-hole spacing for different flexible element designs, said flexible element stacking structures each having wicket pins for alignment with said holes for retaining of the flexible elements onto each corresponding stacking structure, said stacking structure being secured to an indexing conveyor, a pair of wicket pins on each stacking structure conforming to the hole-to-hole spacing for a particular run of flexible elements, each said stacking structure comprising a base unit having an attachment structure for fixedly securing such stacking structure to said indexing conveyor, said base unit being constructed with a slide assembly including a track member secured to and forming a part of the base unit and a pair of slide members slidably mounted on said track member, each of said slide members including a manually operated detent unit mounted to said slide member and having a detent member having a locking portion for engagement with said track member, said track member having a plurality of aligned and longitudinally spaced locking locations, each location being similarly constructed to match said locking portions of said detent member and to releasably engage said locking portion to securely hold the slide member to said track member whereby said two slide members are adapted to be adjustably secured in longitudinally spaced relation in accordance with said locking locations, each of said slide members including a wicket pin support for supporting one of said wicket pins and said pins spaced in accordance with the hole-to-hole spacing of the flexible element.

6. The apparatus of claim 5 wherein said detent unit includes a resilient element establishing the releasable interconnection of said detent member and said locating location.

7. The apparatus of claim 5 wherein said detent member is a spring loaded plunger having an outer end engaging said track member, and each said locking location is a recess matching the outer end of said plunger.

8. A wicket stacking apparatus for receiving a series of flexible elements having aligned spaced holes with a selected hole-to-hole spacing on a given edge portion of the series of flexible elements, comprising a base unit having attachment structure adapted to be interconnected to a movable support for alignment with a flexible element transfer member, a slide assembly secured to said base unit and including a track member extended parallel to the aligned spaced holes of the flexible elements as transferred to said base unit, said slide assembly including a first and a second movable slide member secured to said track member for movement longitudinally of said track member, each of said slide members including a pin support aligned with the holes in said flexible elements as transferred to the base unit and adapted to receive and fixedly support a pin, said slide members being located to space said pins in correspondence with the hole-to-hole spacing in said flexible elements, each said slide member and said track member including a locking unit including a manually movable member secured to said slide member and a series of aligned locking members secured to said track member for selectively securing of each slide member in alignment with one of said locking members, said locking members being spaced in predetermined spacing to permit locating of pins in accordance with said selected hole-to-hole spacing.

9. The apparatus of claim 8 wherein each said base unit includes a base plate, said track member is a solid elongated track having a slide support and secured to said base plate, said track including said aligned locking members in longitudinally spaced locking locations, said locking locations being spaced in accordance with different hole-to-hole spacing in the received flexible elements, a first slide unit and a second slide unit, each slide unit including a slide block having a complementing support mating with said slide support of said track slidably mounted on said track in longitudinally spaced relation to each other for restricted movement only along said track, said slide block extending laterally from said track and terminating in alignment with the aligned spaced holes of the flexible element as received on said base plate, each said block including a pin support for releasably receiving a pin and holding the pin in alignment with the aligned spaced holes of the flexible element; each said locking unit including a detent unit wherein said manually movable member is a plunger unit fixedly secured to said slide block and having a rigid member movable through said slide block into engagement with said track, said locking members including a series of openings and establishing a locked position of said slide member upon alignment and release of said plunger to engage the aligned opening.

10. The apparatus of claim 8 wherein said locking unit comprises a detent unit including a resiliently loaded plunger secured to the slide member, said series of locking members complementing the end of said plunger and defining a firm interlocking engagement with the end of an aligned resiliently loaded plunger.

11. The apparatus of claim 10 wherein said base unit includes a base plate of a length greater than the length of the flexible element to be deposited on said apparatus, said track member being secured to said base plate, said track member having said series of aligned locking members equi-spaced and extending longitudinally of said track member, said manually movable members each including a plunger aligned with said locking members and having a locking end for engagement with the locking members, each said locking member having a configuration adapted to receive the locking end of the plunger and establish a firm interengagement and releasable locking of the slide member to said track member.

12. In a bag forming machine having a first and a second hole forming unit for forming spaced holes in a web formed into bags, said hole forming units adapted to be positioned in predetermined relation to each other to produce different hole spacings in each bag in accordance with particular bag specifications, said hole forming units comprising a slide support assembly comprising an elongated slide member having a plurality of spaced locking elements, a movable slide member for said first hole forming unit and slidably mounted on said elongated slide member, a second movable slide member for said second hole forming unit and slidably mounted on said elongated slide member, said first and second movable slide members each having an individual manually positioned locking element alignable with the spaced locking elements of said elongated slide member for setting said movable slide members in predetermined different spacings in accordance with the location of the locking elements on said elongated slide member, said first and second movable slide members being adapted for respective securement to said first and second hole forming units for adjusting the hole spacing in the bags.

13. The bag forming machine of claim 12, wherein each of said hole forming units is a punch unit comprising a reciprocating punch element, said elongated slide member including a rigid bar mounted in overlying relationship to the path of said web with said punch unit aligned with a portion of said web, each of said movable slide members being mounted on said rigid bar and fixedly connected to said reciprocating punch unit.

14. The bag forming machine of claim 13 wherein each of said movable slide members includes a first and second plate member clamped about said rigid bar and movably supporting said movable slide members on said rigid bar, said plurality of spaced locking elements being formed by openings in said rigid bar, said individually manually positioned locking elements each comprising a spring loaded detent having a locking plunger for alignment with said openings in said elongated rigid bar.

* * * * *